US006106153A

United States Patent [19]

Toshima

[11] Patent Number: 6,106,153

[45] Date of Patent: Aug. 22, 2000

[54] TAPE-SEALED BAG AND METHOD FOR PRODUCING THE SAME

[75] Inventor: Isao Toshima, Kanagawa-ken, Japan

[73] Assignees: Kabushiki Kaisha Hoseki Planning, Tokyo-to; Sanwa Automatic Machinery Co., Ltd., Osaka, both of Japan

[21] Appl. No.: 09/085,062

[22] Filed: May 27, 1998

[30] Foreign Application Priority Data

Jun. 3, 1997 [JP] Japan ..... 9-159304

[51] Int. Cl.[7] ..... B65D 33/28; B65D 33/20

[52] U.S. Cl. ..... 383/204; 383/66; 383/211

[58] Field of Search ..... 383/66, 211, 204, 383/205

[56] References Cited

U.S. PATENT DOCUMENTS

| | | |
|---|---|---|
| 3,166,226 | 1/1965 | Mobley . |
| 3,567,074 | 3/1971 | Brown . |
| 5,310,262 | 5/1994 | Robison et al. . |

FOREIGN PATENT DOCUMENTS

| | | |
|---|---|---|
| 2267680 | 11/1975 | France . |
| 2107795A | 8/1972 | Germany . |
| 2829073B | 10/1979 | Germany . |
| 7-76354 | 3/1995 | Japan . |
| 8-12947 | 1/1996 | Japan . |
| 8301128A | 10/1984 | Netherlands . |

*Primary Examiner*—Stephen P. Garbe
*Attorney, Agent, or Firm*—Jordan and Hamburg LLP

[57] ABSTRACT

In an automatic filling and closing process for flexible package in which a film is supplied while being longitudinally fused, and the respective steps of filling the longitudinally fused film with contents, laterally fusing the film and cutting the laterally fused area are performed, a slit or a hole is intermittently formed in the supplied film, at a site from unwinding of the film to the longitudinal fusing, during interruption of the supply of the film in the steps of lateral fusing and cutting, and an opening fusing tape is placed over the slit or hole to weld around the perimeter of the slit or hole, thereby obtaining a tape-sealed bag which is easily openable in an opening direction approximately parallel with the laterally fused area. According to the invention, the technique of opening the bag by use of the easily openable fusing tape which employs a film having a relatively low separation strength can be applied to the pillow type bag which can be efficiently produced by use of the automatic filling and closing machine for a flexible package.

12 Claims, 4 Drawing Sheets

TAPE-SEALED BAG AND METHOD FOR PRODUCING THE SAME

BACKGROUND OF THE INVENTION

The present invention relates to a pillow type bag sealed with a tape adhered to any portion of a surface of the bag, and easily openable by taking an end of the tape with fingers and pulling it, and a method for producing the same. In particular, the present invention relates to a pillow type bag laterally openable in the vicinity of a laterally fused area of the bag.

In Japanese Unexamined Patent Publication No. 7-76354, the present inventor has proposed a bag in which both side portions of a film thermally fusible in both faces thereof are arranged close to each other, and covered with a separation tape which is fused with outer faces of both side portions of the film to form a cylindrical tube. Both end portions of the tube are then laterally fused. This bag can be easily opened by grasping an end of the tape with fingers and pulling it.

However, according to the above-mentioned technique, the resulting bag is longitudinally opened. Bags are preferably longitudinally opened in some cases, and preferably laterally opened in the other cases, depending on the contents thereof. When the lateral opening is preferred, the above-mentioned technique can not achieve the desired results.

Recently, automatic filling and closing machines have gained wide usage for producing a flexible package. In particular, a film is supplied while being longitudinally fused, and the respective steps of filling the longitudinally fused film with the contents, laterally fusing the film and cutting the laterally fused area are performed in sequence. There is one longitudinally fused area on the back of the resulting bag and no longitudinally fused area on a surface of the bag, and both the upper and lower ends are laterally fused. This is a so-called pillow type bag, and has widely prevailed.

If this pillow type bag could be opened at its upper portion in a direction approximately parallel with the laterally fused area by pulling the tape, such bag would demonstrate both desirable sealing performance and ease of opening. However, it was heretofore difficult to produce such a bag even by the technique described in Japanese Unexamined Patent Publication No. 7-76354.

Moreover, for the contents, it is generally desirable to laterally open the sealed bag from one end thereof in the longitudinal direction in many cases. Accordingly, a bag has been desired which can be easily opened in parallel with a laterally fused area by pulling an opening fusing tape.

SUMMARY OF THE INVENTION

The present invention provides a method for producing a tape-sealed bag by an automatic filling and closing process for a flexible package in which a film is supplied while being longitudinally fused, and the respective steps of filling the longitudinally fused film with the contents, laterally fusing the film and cutting the laterally fused area are performed, comprising intermittently forming a slit or a hole in the supplied film at a site from unwinding of the film to the longitudinal fusing during interruption of the supply of the film in the steps of lateral fusing and cutting, and placing an opening fusing tape over said slit or hole to weld around the circumference of said slit or hole. The invention further provides an easily openable tape-sealed bag produced by this method.

In a vertical type automatic filling and closing machine for flexible package used in the present invention, the bag forming speed is usually 40 to 45 bags/minute, and up to about 60 bags/minute, and the supply of the film is interrupted in the steps of lateral fusing and cutting. Utilizing this interruption, the slit or the hole is formed in the lateral direction of the film, and this opening portion is covered with the opening fusing tape to weld around the perimeter thereof in the next interruption. The present inventor has confirmed that such processing can be performed over a short period of 1 second or less, thus completing the present invention.

The film in which the slit or the hole is formed, and with which the opening fusing tape covering the slit or the hole is fused, is supplied as such to a usual automatic filling and closing machine for a flexible package, thereby obtaining the tape-sealed bag of the present invention. The tape-sealed bag of the present invention is unique in that the slit and the tape are provided in a direction running approximately parallel, i.e. codirectional, with the laterally fused area of the pillow type bag. Conventionally, a slit in parallel with a longitudinally fused area could be formed. In this case, however, a horizontal type automatic filling and closing machine for a flexible package had to be used, resulting in poor efficiency.

DESCRIPTION OF THE PREFERRED EMBODIMENTS

Figure 1A:
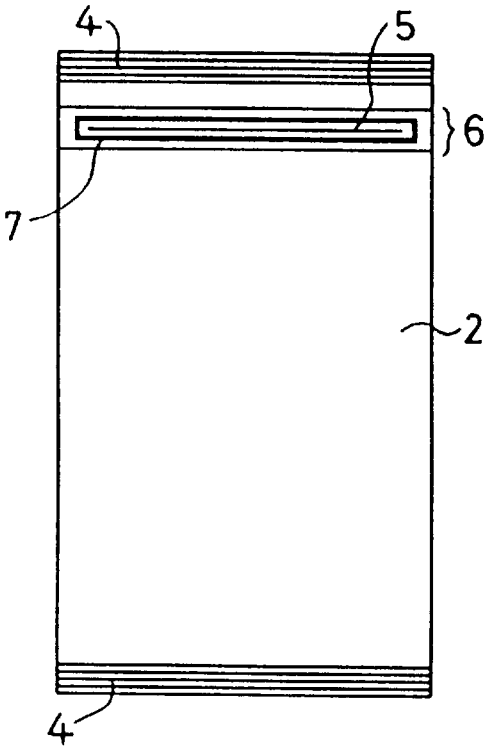
FIG. 1*a* is a plan view showing the surface of a sealed bag of the present invention.

Base films used in the sealed bags of the present invention are films of various plastics such as polypropylene, polyesters, polyethylene and nylon, laminated products thereof and products thereof laminated with aluminum evaporation layers, paper or polyvinylidene chloride layers. These base films are provided on both sides thereof with heat fusible layers having a low melting point, such as low-density polyethylene and ethylene-vinyl acetate copolymer layers. When the base films are films which are heat fusible themselves, such as polyethylene films and polypropylene films, they may be monolayer films having no heat fusible layers.

The longitudinally fused area, as used in the present invention, is a fused area formed in a supplying direction of the film forming the bag, and the laterally fused area is a fused area formed in a direction crossing the supplying direction of the film forming the bag, independently of the ratio of lengths of the completed bag.

The pillow type bag, as used in the present invention, is a bag produced with a vertical type automatic filling and closing machine for a flexible package and having one longitudinally fused area 3 on the back 1 thereof, no longitudinally fused area 3 on the obverse surface 2 thereof and laterally fused areas 4 at both the upper and lower ends thereof. Accordingly, bags fulfilling these conditions are all included in the scope of the present invention. In addition, a gusset type bag having folds on both sides is also naturally included.

In the present invention, an easily separable tape generally used for a cover material of a vessel for jelly and yoghurt, so as to be openable by hand, is employed as an opening fusing tape 6. The easily separable films are widely commercially available, and include, for example, VMX22RX manufactured by Mitsubishi Chemical Corporation, CMPS07C manufactured by Tosero Co. Ltd and TAF610C manufactured by Tosero Co. Ltd.

The peel strength of the easily separable films is 100 g/15 mm to 1500 g/15 mm, and preferably 300 g/15 mm to 1000 g/15 mm, and the fused width thereof is generally 1 mm to 3 mm.

The easily separable films are used by backing them with films of polyesters, nylon, polypropylene and the like, and cutting them to the tape form. They may be backed after cutting to the tape form.

In the present invention, a slit 5 is formed in parallel with the laterally fused area 4 on the surface 2 of the bag. The slit 5 is not required to be accurately parallel, and may be slant to the laterally fused area, i.e. codirectional with the laterally fused area 4 of the bag and crosswise the supplying direction. However, the parallel slit is generally easy to use. Although there is no limitation on its position, the upper or lower end is preferred, and a position close to the laterally fused area and not in contact therewith is preferred.

The opening fusing tape 6 is placed on a bag material, covering this slit 5, to weld around the perimeter of the slit with no clearance between the tape and the bag material. A tape-fused area 7 covering the slit is preferably in place in the obverse surface 2 of the bag. Further, the slit 5 may be shortened so that only a part of the width of the obverse surface 2 of the bag opens, depending on the contents, fluid or solid. The opening fusing tape 6 is required to have a pick-up flap 8 not fused by a length which can be grasped with fingers, outside the tape-fused area at at least one end thereof.

At the end of pick-up flap 8, the opening fusing tape 6 is fused in a dot-like form, leaving the pick-up flap 8 not fused by a length which can be grasped with fingers. In particular, it is preferred that the tape is fused in a dot-like form, leaving the pick-up flap 8 not fused by a length which can be grasped with fingers, wherein the pick-up flap 8 is allowed to project from the surface of the bag and turned up to the back. In such a dot-like fused area 9, white dots remain after separation. Accordingly, even if an opened bag is placed so as to be confused with goods not opened with malicious intent, it can be immediately distinguished.

Figure 2:
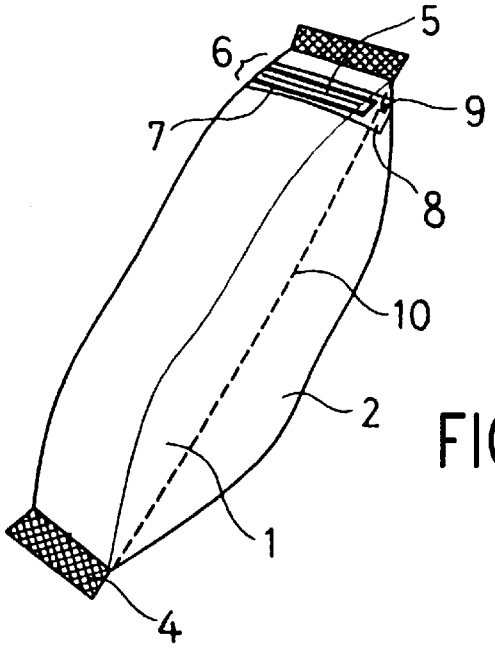
FIG. 2 is a perspective view showing the sealed bag of FIG. 1.
Figure 3:
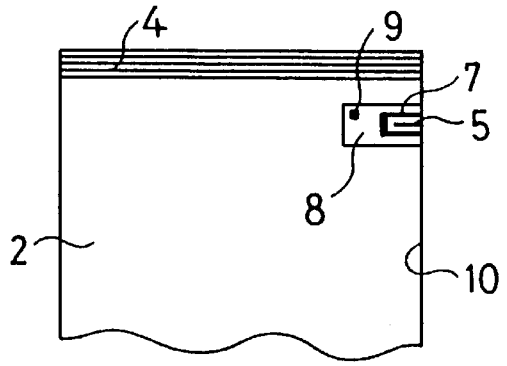
FIG. 3 is a plan view showing a bag in which a short slit is formed at a side portion thereof.
Figure 6:
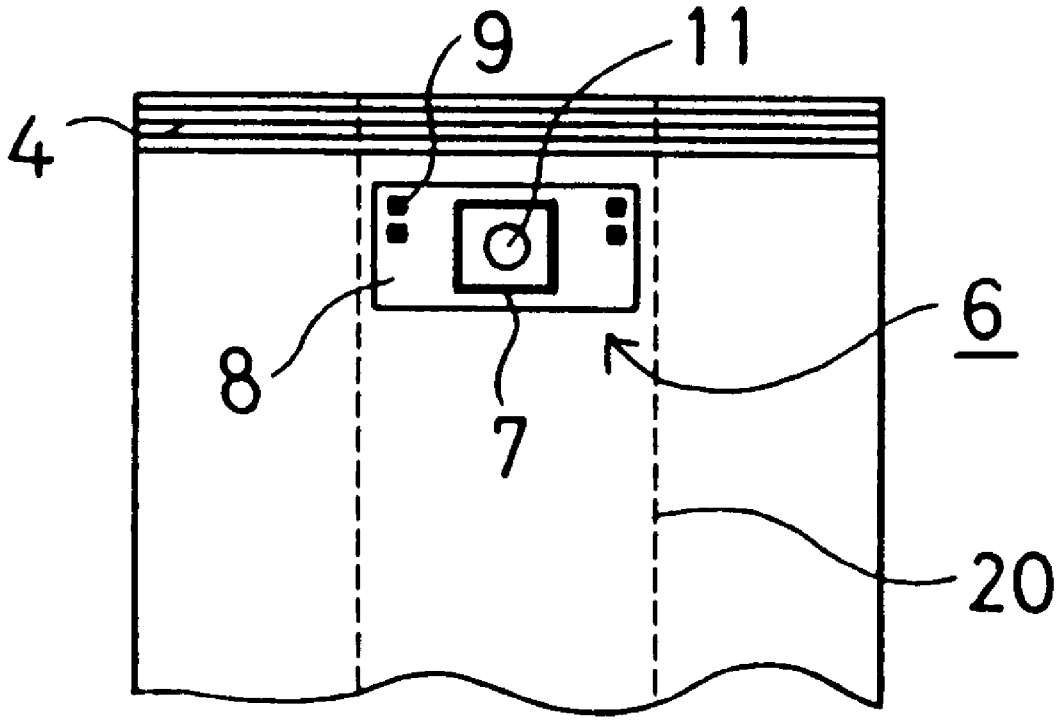
FIG. 6 is a plan view showing the surface of an embodiment of the present invention using a gusset fold bag.

FIG. 2 is a perspective view showing the sealed bag thus obtained. The slit 5 is not necessarily formed within a region of the obverse surface 2 of the bag, and may be formed short in a side portion 10 of the bag, namely a portion forming the boundary between the obverse surface 2 and the back 1 where the film is folded, as shown in FIG. 3. Instead of the slit 5, a hole 11 may be formed as shown in FIG. 6. The formation of the short slit 5 or the hole 11 across the side portion 10 provides the advantage of easy handling when the bag contains contents such as solid, fluid or semifluid contents which are liable to be scattered about in taking out them at once. Further, two or more short slits can also be formed, making them cross or with ends thereof brought into contact with each other.

Further, when adhesive is exposed on a face of the opening fusing tape 6 or a separation face of the bag after the bag is opened by pulling the tape, the opened bag can be sealed again, which is preferred from the viewpoint of maintaining the airtightness of the contents after opening.

Figure 4A:
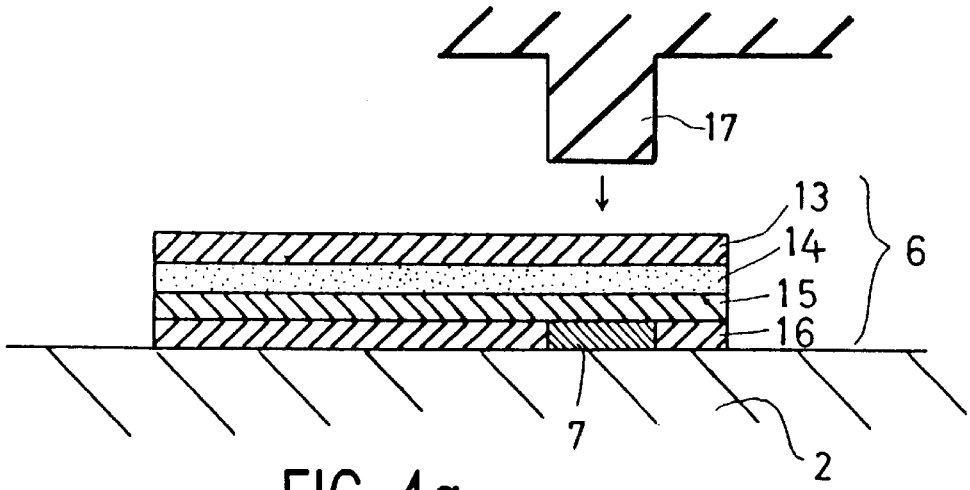
FIG. 4*a* is cross sectional showing a bag using an opening fusing tape containing an adhesive, illustrating the step of fusing the tape with a bag material.
Figure 4B:
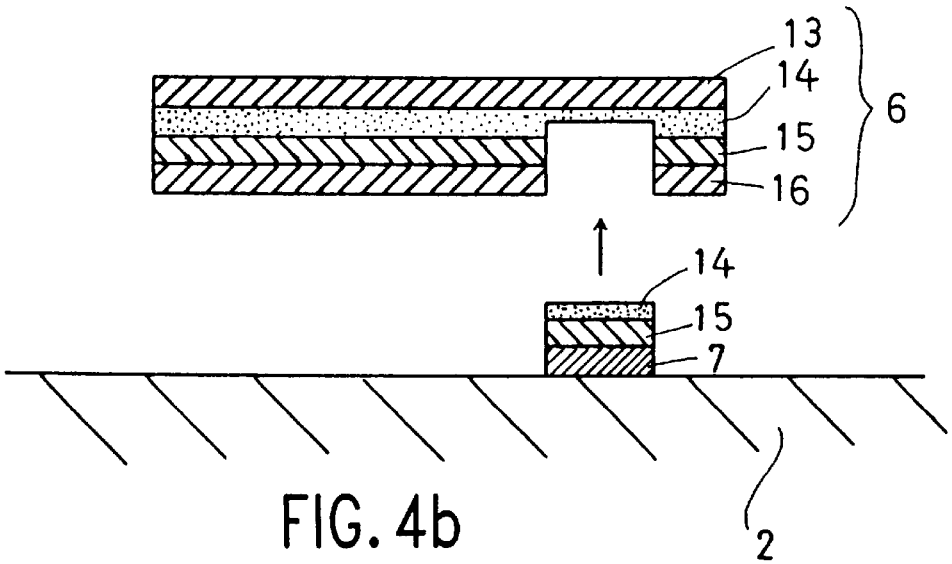
FIG. 4*b* is a cross sectional view of the bag of FIG. 4*a*, illustrating a phenomenon that an adhesive layer is exposed when the tape is separated.

To achieve this end, the opening fusing tape 6 is comprised of a substrate layer 13 laminated with an adhesive layer 14, a tearable layer 15 formed of a material which is torn in any direction by weak force and a heat fusible layer 16, as shown in FIG. 4. As the tearable layer 15, an aluminum foil, ordinary paper composed of staple fibers or a plastic film treated so as to be torn in all directions (for example, a film allowed to contain many bubbles) can be used.

The slit or the hole is covered with this opening fusing tape 6, and the perimeter surrounding the slit or the hole is heat pressed with a heat sealer 17. As a result, a portion of the opening fusing tape corresponding to the heat sealer 17 is fused with the bag material (the obverse surface 2 of the bag in the example of FIG. 4(*a*)) to maintain the bag in the sealed state. When the opening fusing tape 6 is pulled at an end thereof, the adhesive layer 14 is separated because of strong heat fusion, as shown in FIG. 4(*b*). The tearable layer 15 is approximately surely torn at an interfacial portion between a fused area and a non-fused area when the tape is separated. On the other hand, although the heat fusible layer 16 is formed of a material not ordinarily torn only by pulling, it is laminated with the film layer such as the aluminum foil which is torn in all directions by weak force. Accordingly, the extendable characteristics disappear and the heat fusible layer 16 is easily torn together with the tearable layer 15, resulting in exposure of the adhesive layer.

Thus, the use of the opening fusing tape 6 containing the adhesive layer 14 permits the bag to be sealed again by virtue of the adhesive nature of the adhesive layer 14 which is exposed after opening, and the contents to be stored for a long period of time.

Figure 5:
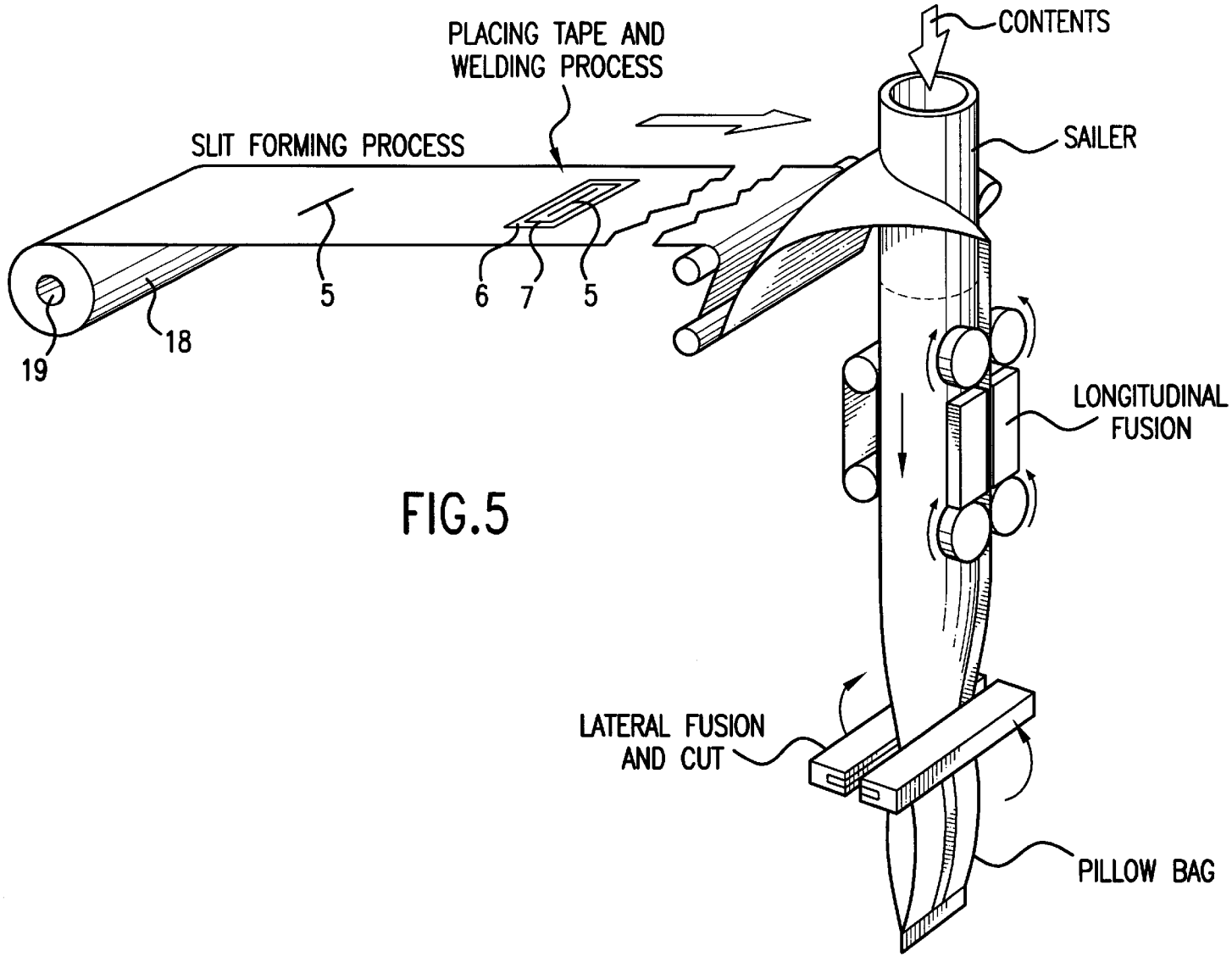
FIG. 5 is a schematic view for illustrating a method for producing a sealed bag of the present invention.

FIG. 5 is a schematic view illustrating a method for producing the sealed bag of the present invention. The reference numeral 18 designates a wound film, and 19 designates a winding core. The film, unwound by a conventional method, is supplied to an automatic filling and closing machine for a flexible package. In the automatic filling and closing machine for a flexible package, there are the steps of laterally fusing the film and cutting a central portion of the laterally fused area after termination of longitudinal fusion and filling. In these steps, the supply of the film is interrupted. At this moment, the slit 5 or the hole 11 is formed in the film before it enters the automatic filling and closing machine for flexible package. In other words, the slit 5 or the hole 11 is formed before the unwound film is longitudinally fused. At the moment when the supply of the film is interrupted next, the tape is fused with the bag material. That is to say, the slit or the hole is covered with the opening fusing tape 6, which is fused with the bag material around the perimeter of the opening portion. Then, using the conventional automatic filling and closing machine for flexible package, the pillow type bag can be efficiently produced by the conventional method.

According to the present invention, the technique of opening the bag by means of the easily openable fusing tape using the film having a relatively low separation strength can be applied to the pillow type bag which can be efficiently produced by use of the automatic filling and closing machine for a flexible package.

EXAMPLES

Using a wound film 18 having a width of 340 mm in which both faces of a 15 μm thick nylon film were laminated with 40 μm thick linear low-density polyethylene films, a pillow type bag was produced with a conventional automatic filling and closing machine for a flexible package, as shown in FIG. 5.

In this embodiment, a slit 5 was formed in a direction crossing the film between unwinding of the film and winding thereof around a sailor of the automatic filling and closing machine for flexible package, as shown in FIG. 5. The slit was formed to a length of 132 cm in a central portion of the film. At the moment when the supply of the film is interrupted next, an opening fusing tape 6 was placed over the slit 5 and welded around the perimeter of the slit 5. An 18 mm wide tape was used as the opening fusing tape 6, in which an inner face of a 16 μm thick polyester film was laminated with a 50 μm thick easily separable film. As the easily separable film, CMPS017C manufactured by Tosero Co. Ltd was used.

Figure 1B:
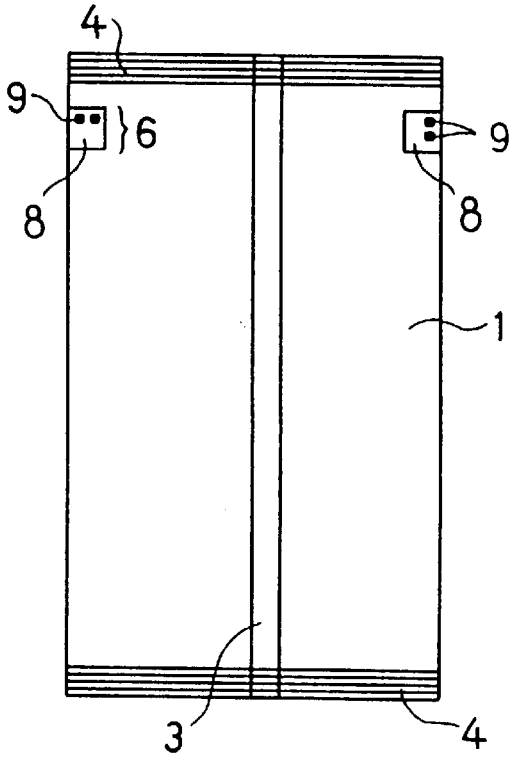
FIG. 1*b* is a plan view showing the back of the sealed bag of the present invention.

Inner faces of both sides of the film were allowed to face each other and fused with each other (inner to inner) to form a cylindrical tube. The tube was filled with cookies as the contents supplied from a hopper, laterally fused and cut at a central portion thereof. As a result, a sealed bag having the surface as shown in FIG. 1 was obtained.

The sealed bag had a bag width of 160 mm, a bag length of 235 mm and a 15 mm wide laterally fused area.

Further, when a 180 cm long opening fusing tape 6 was placed over the slit and fused, two dot-like fused areas 9 were each formed at upper ends of positions of 3 mm and 7 mm from both ends of the opening fusing tape 6. A bag produced therefrom was as shown on the left side of FIG. 1(*b*), and the opening fusing tape 6 was extended slightly out of the obverse surface 2 of the bag. Two dot-like fused areas 9 were each formed at an upper end of a portion out of the surface. A lower portion of the dot-like fused areas 9 was left unfused to form a pick-up flap 8 which could help to first initiate opening of the bag. When two dot-like fused areas 9 were vertically arranged as shown on the right side of FIG. 1(*b*), a pick-up flap 8 was formed on the left side of the dot-like fused areas 9.

The fused portion of the opening fusing tape 6 turns white after separation, so that it can be distinguished at a glance that the tape is separated. As a result, when goods placed on display are opened and sealed again after insertion of a poisonous substance with malicious intent, users can immediately distinguish them. This is therefore preferred in terms of the safety of goods.

FIG. 6 shows another embodiment, in which a gusset bag was used as the pillow type bag. The reference numeral 20 designates a gusset fold line. In this embodiment, a hole 11 was formed in a central portion having no gusset fold, a tape-fused area 7 was formed around the hole 11, and two pairs of dot-like fused areas 9 were each formed at upper ends of the tape, so that a pick-up flap 8 was formed under the fused areas of the opening fusing tape 6. The bag was filled with refined table salt to obtain pouched refined table salt for refilling. The sealed bag was squarely expanded. When one pick-up flap 8 was taken with fingers and pulled, the hole was opened, and the contents could be surely poured from the hole into a refined table salt bottle.

What is claimed is:

1. A tape-sealed bag, comprising:

an enclosing structure including an obverse side and a back, said enclosing structure being formed of a film presenting first and second faces which are both heat fusible, opposed ends of the film being brought together in overlapping engagement and sealably connected one to another along a longitudinally fused area to thereby define an encircling structure of tubular configuration, and a length portion of said encircling structure including laterally fused areas at both upper and lower ends thereof thereby sealably closing said length portion of said encircling structure to define said enclosing structure, said longitudinally fused area being positioned on the back of the enclosing structure, and there being no other longitudinally fused area on the obverse side thereof;

the film including an opening of desired shape formed therein;

an opening fusing tape for covering said opening, said opening fusing tape being comprised of a laminated structure including a tearable layer provided in a tape form which is backed with a heat film on at least one side thereof serving as an outermost heat fusible layer and on a remaining side with a substrate layer, the outermost heat fusible layer of said opening fusing tape being fused with a portion of the film around a perimeter of said opening, such that when said opening fusing tape is pulled by a user, the heat fusible layer, over an area in which it is fused to the film around the perimeter of the opening, is separated from a remainder of said laminated structure by tearing along with the tearable layer such that the user has access to a contents of said enclosing structure without requiring tearing of said enclosing structure.

2. A tape-sealed bag as claimed in claim 1, in which said opening is a slit, said slit being formed codirectionally with the laterally fused areas.

3. A tape-sealed bag as claimed in claim 1, in which said opening is formed within a region of the obverse side of the enclosing structure.

4. A tape-sealed bag as claimed in claim 3, in which at least one end of the opening fusing tape is turned up to the back of the bag, and at least one dot-like fused area exists on the back, leaving an area not fused which can be taken with fingers.

5. A tape-sealed bag as claimed in claim 1, in which the tearable layer has a peel strength from the bag material of 100 g/15 mm to 1500 g/15 mm.

6. A tape-sealed bag, comprising:

an enclosing structure including an obverse side and a back, said enclosing structure being formed of a film presenting first and second faces which are both heat fusible, opposed ends of the film being brought together in overlapping engagement and sealably connected one to another along a longitudinally fused area to thereby define an encircling structure of tubular configuration, and a length portion of said encircling structure including laterally fused areas at both upper and lower ends thereof thereby sealably closing said length portion of said encircling structure to define said enclosing structure, said longitudinally fused area being positioned on the back of the enclosing structure, and there being no other longitudinally fused area on the obverse side thereof;

the film including an opening of desired shape formed therein; and an opening fusing tape for covering said opening, said opening fusing tape being fused with a a portion of the film around a perimeter of said opening, said opening fusing tape comprising a substrate, an adhesive layer laminated on one face thereof and heat fusible layer laminated thereon through a material film layer which is torn in any direction by weak force.

7. A tape-sealed bag as claimed in claim 6, in which said opening is a slit, said slit being formed codirectionally with the laterally fused areas.

8. A tape-sealed bag as claimed in claim 6, in which said opening is formed within a region of the obverse side of the enclosing structure.

9. A tape-sealed bag as claimed in claim 8, in which at least one end of the opening fusing tape is turned up to the back of the bag, and at least one dot-like fused area exists on the back, leaving an area not fused which can be taken with fingers.

10. A tape-sealed bag produced by an automatic filling and closing machine for a flexible package in which a film is supplied while being longitudinally fused, and the respective steps of filling the longitudinally fused film with the contents, laterally fusing the film and cutting the laterally fused area are performed, the tape sealed bag being formed by a process comprising:

intermittently forming an opening of desired shape in the film at a site from unwinding of the film to a position corresponding to the longitudinal fusing during interruption of the supply of the film in the steps of lateral fusing and cutting;

placing an opening fusing tape over said opening, said opening fusing tape being comprised of a laminated structure including a tearable layer provided in a tape form which is backed with a heat film on at least one side thereof serving as an outermost heat fusible layer and on a remaining side with a substrate layer; and fusing the outermost heat fusible layer of said opening fusing tape with a portion of the film around a perimeter of said opening, such that when said opening fusing tape is later pulled by a user, the heat fusible layer, over an area in which it is fused to the film around the perimeter of the opening, is separated from a remainder of said laminated structure by tearing along with the tearable layer such that the user has access to a contents of said enclosing structure without requiring tearing of said enclosing structure.

11. A tape-sealed bag as claimed in claim 1, wherein the tearable layer has a peel strength from the bag material of 300 g/15 mm to 1000 g/15 mm.

12. A tape-sealed bag as claimed in claim 1, wherein the tearable layer is selected from the group consisting of aluminum foil, paper comprised of staple fibers and a plastic film treated so as to be tearable in all directions.

* * * * *